US008936169B2

(12) United States Patent
Lui

(10) Patent No.: US 8,936,169 B2
(45) Date of Patent: Jan. 20, 2015

(54) VACUUMIZED CONTAINER BOX

(71) Applicant: To Yan Lui, Guangdong Province (CN)

(72) Inventor: To Yan Lui, Guangdong Province (CN)

( * ) Notice: Subject to any disclaimer, the term of this patent is extended or adjusted under 35 U.S.C. 154(b) by 237 days.

(21) Appl. No.: 13/705,171

(22) Filed: Dec. 5, 2012

(65) Prior Publication Data

US 2013/0292291 A1 Nov. 7, 2013

(30) Foreign Application Priority Data

May 4, 2012 (CN) ..... 2012 2 0196188 U

(51) Int. Cl.
*B65D 41/56* (2006.01)
*B65D 81/20* (2006.01)

(52) U.S. Cl.
CPC ..... *B65D 81/20* (2013.01); *B65D 81/2015* (2013.01); *B65D 81/2038* (2013.01)
USPC ..... 220/212; 206/524.8; 215/228; 215/260; 215/262; 215/312; 220/203.21; 220/231

(58) Field of Classification Search
USPC ..... 206/524.8, 216; 141/65; 215/228, 260, 215/262, 311, 312, 315; 220/202, 203.01, 220/203.07, 203.11, 203.1, 203.21, 212, 220/231, 367.1; 251/322, 323, 315.01, 339
See application file for complete search history.

(56) References Cited

U.S. PATENT DOCUMENTS

| | | | | | |
|---|---|---|---|---|---|
| 4,162,021 | A * | 7/1979 | Crute | 220/202 |
| 4,763,802 | A * | 8/1988 | Johnston | 215/228 |
| 5,499,735 | A * | 3/1996 | Chen | 220/231 |
| 5,558,243 | A * | 9/1996 | Chu | 220/212 |
| 5,651,470 | A * | 7/1997 | Wu | 220/212 |
| 5,692,632 | A * | 12/1997 | Hsieh et al. | 220/212 |
| 5,992,666 | A * | 11/1999 | Wu | 220/212 |
| 6,644,489 | B2 * | 11/2003 | Chang | 220/203.01 |
| 6,994,227 | B2 * | 2/2006 | Kwon | 220/212 |
| 7,296,598 | B2 * | 11/2007 | Lin et al. | 141/65 |

* cited by examiner

*Primary Examiner* — Luan K Bui

(57) ABSTRACT

A vacuumized container box having a box body opened at its upper end and constructed in a shape of a container; a box cover is provided at the upper end of the box body; an air outlet opening is provided on the box cover; a vacuumizing device is provided on the air outlet opening for vacuumizing the box body; the vacuumizing device comprises a vacuum operation button and air pumps; the vacuum operation button is provided at an upper end of the box cover; the air pumps are actuated by the vacuum operation button and are provided at a bottom end of the box cover. Since the vacuumized container box is configured to incorporate the vacuumizing device, no other extra vacuumizing devices are required. The vacuumized container box is therefore convenient to use and attains good vacuumization.

3 Claims, 1 Drawing Sheet

VACUUMIZED CONTAINER BOX

BACKGROUND OF THE INVENTION

The present invention relates to a kind of daily commodity, and more specifically relates to a vacuumized container box.

At present, box-shaped containers are very common in our daily life. However, many existing box-shaped containers could not be vacuumized. Articles stored inside such containers could easily develop moulds and turn bad because water exists in the air inside the containers. Nowadays, vacuumized bags have been developed for storing clothes. However, the existing vacuumized bags could be easily damaged, and they are also inconvenient to use because air pumps are required for vacuumization. Furthermore, such vacuumized bags could not be used for storing other items such as food items.

BRIEF SUMMARY OF THE INVENTION

The present invention provides a vacuumized container box attainable according to the following technical proposal: A vacuumized container box, characterized in that the vacuumized container box has a box body opened at its upper end and constructed in a shape of a container; a box cover is provided at the upper end of the box body; an air outlet opening is provided on the box cover; a vacuumizing device is provided on the air outlet opening for vacuumizing the box body; the vacuumizing device comprises a vacuum operation button and air pumps; the vacuum operation button is provided at an upper end of the box cover; the air pumps are actuated by the vacuum operation button and they are provided at a bottom end of the box cover.

Furthermore, in the above mentioned vacuumized container box, the air pumps arranged in sequential order according to a direction from top to bottom of the vacuumized container box are air pump A, air pump B, and air pump C; air pump A and air pump B are fitted with each other and form a cavity in between them; the cavity contains an actuation spring and a stainless steel ball for sealing an air opening of the air pump C; a seal ring A and a seal ring B are provided at an upper end and a bottom end of the air pump A respectively; a seal ring C is provided at a bottom side of the air pump B; a seal ring D is provided at an upper end of the air pump C; a cover air inlet valve is provided at a top end of the air pump A; a box seal ring is provided at a locking part between the box body and the box cover; grooves for easier vacuumizing operation are distributed on the box cover near to the vacuum operation button.

Compared with the existing prior arts, the vacuumized container box of the present invention is characterized in that it has a box body constructed in a shape of a container and opened at its upper end; a box cover is provided at the upper end of the box body; an air outlet opening is provided on the box cover; a vacuumizing device is provided on the air outlet opening for vacuumizing the box body; the vacuumizing device comprises a vacuum operation button and air pumps; the vacuum operation button is provided at an upper end of the box cover; the air pumps are actuated by the vacuum operation button and provided at a bottom end of the box cover. Since the vacuumized container box is configured to incorporate the vacuumizing device, no other extra vacuumizing devices are required. Therefore, the present invention is convenient to use and attains good vacuumization.

Reference numbers in the figures are detailed as follows:

1—box body; 2—box cover; 3—vacuum operation button; 4—air pump A; 5—air pump B; 6—seal ring A; 7—seal ring B; 8—cover air inlet valve; 9—seal ring C; 10—air pump C; 11—stainless steel ball; 12—seal ring D; 13—actuation spring; 14—box seal ring; 15—air outlet opening; 16—grooves.

DETAILED DESCRIPTION OF THE INVENTION

The present invention is further explained below with reference to the accompanying FIG. 1.

Figure 1:
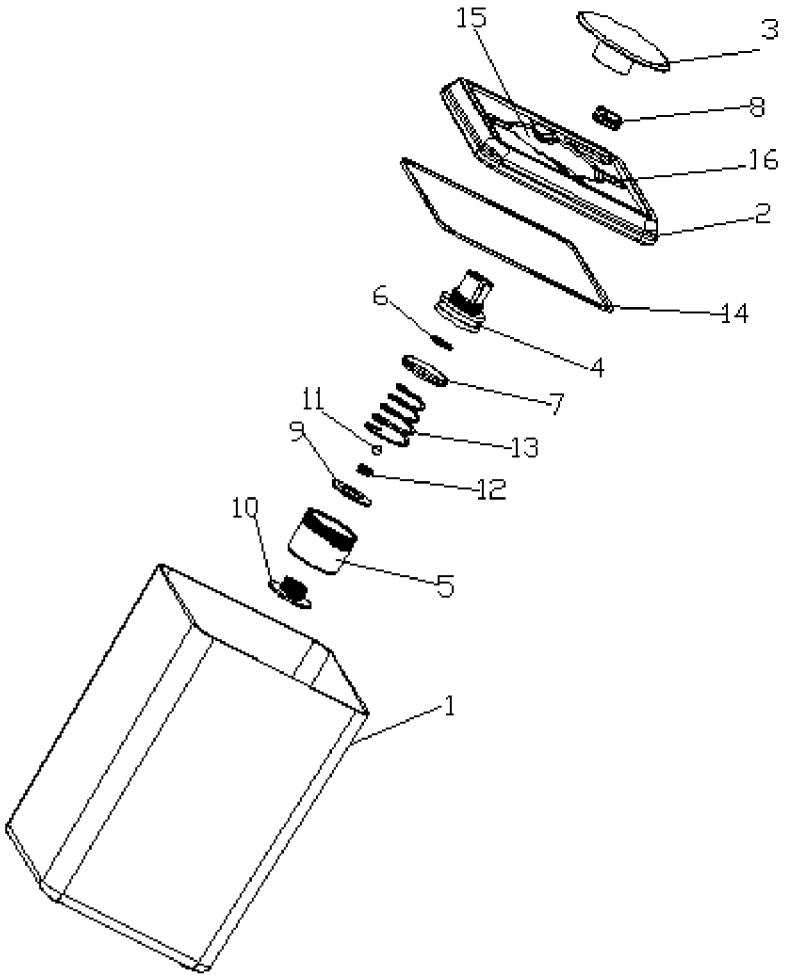
FIG. 1 is an exploded view illustrating the vacuumized container box according to the present invention.
Figure 2:
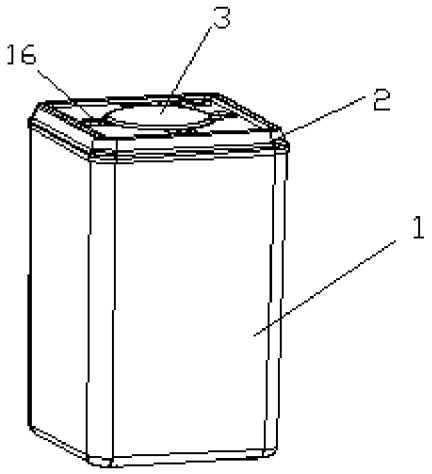
FIG. 2 illustrates an overall structure of the vacuumized container box according to the present invention.

As shown in FIG. 1, a vacuumized container box has a box body 1 opened at its upper end and constructed in a shape of a container. A box cover 2 is provided at the upper end of the box body 1. An air outlet opening 15 is provided on the box cover 2. A vacuumizing device is provided on the air outlet opening 15 for vacuumizing the box body 1. The vacuumizing device comprises a vacuum operation button 3 and air pumps. The vacuum operation button 3 is provided at an upper end of the box cover 2. The air pumps are actuated by the vacuum operation button 3 and provided at a bottom end of the box cover 2. The air pumps arranged in sequential order according to a direction from top to bottom of the vacuumized container box are air pump A 4, air pump B 5, and air pump C 10. Air pump A and air pump B are fitted with each other and form a cavity in between them. The cavity contains an actuation spring 13 and a stainless steel ball 11 for sealing an air opening of the air pump C 10. A seal ring A 6 and a seal ring B 7 are provided at an upper end and a bottom end of the air pump A 4 respectively. A seal ring C 9 is provided at a bottom side of the air pump B 5. A seal ring D 12 is provided at an upper end of the air pump C 10. A cover air inlet valve 8 is provided at a top end of the air pump A 4. A box seal ring 14 is provided at a locking part between the box body 1 and the box cover 2. Grooves 16 for easier vacuumizing operation are distributed on the box cover 2 near to the vacuum operation button 3.

When the box body 1 is locked with the box cover 2, press the vacuum operation button 3. The stainless steel ball 11 will then seal the air opening disposed at an upper end of the air pump C 10. When the actuation spring 13 extends, the stainless steel ball 11 will also move upward. Therefore, air inside the box body 1 will first enter the air pump C 10 and then flows through the air pump B 5 and the air pump A 4 and eventually exits through openings at the vacuum operation button 3. Repeat the above procedures until the container box is vacuumized. To open the box cover 2, pull the cover air inlet valve 8 so that air will first enter the air pumps and then flows through the box body 1 whereupon the box cover 2 could be opened easily.

The above description is only a preferred embodiment of the present invention. Any other obvious replacement and modification falling within the technical proposal of the present invention should be included in the scope of protection of the present invention.

What is claimed is:

1. A vacuumized container box, characterized in that the vacuumized container box has a box body (1) opened at its upper end and constructed in a shape of a container; a box cover (2) is provided at the upper end of the box body; an air outlet opening (15) is provided on the box cover; a vacuumizing device is provided on the air outlet opening for vacuumizing the box body; the vacuumizing device comprises a vacuum operation button (3) and air pumps; the vacuum operation button is provided at an upper end of the box cover; the air pumps are actuated by the vacuum operation button and are provided at a bottom end of the box cover: the air pumps arranged in sequential order according to a direction from top to bottom of the vacuumized container box are air pump A (4). air pump B (5). and air pump C (10); the air pump A and the air pump B are fitted with each other and a cavity is formed in between the air pump A and the air puma B: the cavity contains an actuation spring (13) and a stainless steel ball (11) for sealing an air opening of the air pump C; a seal ring A (6) and a seal ring B (7) are provided at an upper end and a bottom end of the air pump A respectively; a seal ring C (9) is Provided at a bottom side of the air pump. B; a seal ring D (12) is provided at an upper end of the air pump C; a cover air inlet valve (8) is provided at a tog end of the air pump A (4).

2. The vacuumized container box as in claim 1, characterized in that a box seal ring (14) is provided at a locking part between the box body and the box cover (2).

3. The vacuumized container box as in claim 1, characterized in that grooves (16) for easier vacuumizing operation are distributed on the box cover near to the vacuum operation button (3).

* * * * *